United States Patent [19]

Hughes et al.

[11] 4,318,027

[45] Mar. 2, 1982

[54] HIGH POTENTIAL, LOW MAGNIFICATION ELECTRON GUN

[75] Inventors: Richard H. Hughes, Lancaster; Hsing-Yao Chen, Landisville, both of Pa.

[73] Assignee: RCA Corporation, New York, N.Y.

[21] Appl. No.: 78,134

[22] Filed: Sep. 24, 1979

Related U.S. Application Data

[63] Continuation-in-part of Ser. No. 895,588, Apr. 12, 1978, abandoned.

[51] Int. Cl.[3] ..... H01J 29/46; H01J 29/56

[52] U.S. Cl. ..... 315/15; 313/449

[58] Field of Search ..... 315/14, 15; 313/449, 313/458

[56] References Cited

U.S. PATENT DOCUMENTS

| | | |
|---|---|---|
| B 381,074 | 1/1975 | Hasker et al. . |
| 3,008,064 | 11/1961 | Niklas et al. . |
| 3,090,882 | 5/1963 | Benway . |
| 3,295,001 | 12/1966 | Burdick et al. . |
| 3,374,379 | 3/1968 | Maruyama et al. . |
| 3,437,868 | 4/1969 | Ohkoshi et al. . |
| 3,772,554 | 11/1973 | Hughes . |
| 3,866,081 | 2/1975 | Hasker et al. . |
| 3,873,878 | 3/1975 | Odenthal . |
| 3,995,194 | 11/1976 | Blacker, Jr. et al. . |

FOREIGN PATENT DOCUMENTS

| | | |
|---|---|---|
| 1156511 | 10/1958 | Fed. Rep. of Germany . |
| 1489160 | 4/1969 | Fed. Rep. of Germany . |
| 2459091 | 4/1975 | Fed. Rep. of Germany . |
| 447493 | 5/1936 | United Kingdom . |
| 976174 | 11/1964 | United Kingdom . |
| 1256507 | 12/1971 | United Kingdom . |
| 1308086 | 2/1973 | United Kingdom . |
| 1460120 | 12/1976 | United Kingdom . |

OTHER PUBLICATIONS

H. Moss, Narrow Angle Electron Guns and Cathode Ray Tubes, Academic Press, N.Y., 1968, pp. 156–158.

Takenaka et al, New Hi-Fi Focus Electron Gun for Color Cathode Ray Tube, Toshiba Review, No. 121, May 1979, pp. 30–35.

*Primary Examiner*—Theodore M. Blum

*Attorney, Agent, or Firm*—Eugene M. Whitacre; Glenn H. Bruestle; Dennis H. Irlbeck

[57] ABSTRACT

The electron gun, which is especially adapted for use in color picture tubes, comprises in the order named: a cathode, an apertured-plate control grid (G1), an apertured-plate screen grid (G2), and at least two tubular focusing electrodes. The quality of the gun's beam spot is improved by: 1. Establishing an operating electric field between the G2 and G3 which is between about 100 and 400 volts/mil, thereby reducing aberration effects in the beam-forming region of the gun; 2. Making the G2 thick so as to prevent the high G3 voltage from penetrating the region between the G1 and G2, thereby allowing the G1–G2 field to provide a divergent effect on the electron beam prior to beam crossover and thus give a reduced crossover angle; 3. Spacing the main focusing lens at a distance from the G2 so as to provide an optimum filling of the main focus lens with the beam to maximize the object distance of the focusing system; and 4. Structuring the G2 and G3 to provide a flat electrostatic field therebetween to avoid prefocusing action in that region, so as not to cause an effective reduction of the object distance of the focusing system.

22 Claims, 15 Drawing Figures

HIGH POTENTIAL, LOW MAGNIFICATION ELECTRON GUN

This is a continuation-in-part of our copending application Ser. No. 895,588 filed Apr. 12, 1978, now abandoned.

BACKGROUND OF THE INVENTION

This invention relates to cathode ray tubes, and particularly to color picture tubes of the type useful in home television receivers, and to electron guns therefor.

As shown schematically in FIG. 1, electron guns typically used in color picture tubes comprise a plurality of aligned electrodes including a cathode 2, control grid 3, screen grid 4, and two or more focusing electrodes 5 and 6. That portion of the gun up to the screen grid constitutes the beam forming region 7 and that portion beyond the screen grid constitutes the focusing region 8. In the operation of these guns, electrons 9 are emitted from the cathode and converged to a crossover 10 in the vicinity of the screen grid. This crossover is then imaged at an image plane on a screen 11 as a small spot by a main focus lens established between electrodes 5 and 6 in the focusing region of the gun. The convergence angle $\alpha$ at which the electrons approach the crossover is herein termed the crossover entrance angle, and the divergence angle $\beta$ at which the electrons leave the crossover is herein termed the crossover exit angle. The angles $\alpha$ and $\beta$ would be substantially equal to each other in the absence of any deflection field at the crossover. However, in actual practice the presence of electric fields in this region causes a constant bending of the electron rays as they enter and exit from the crossover, thus producing a complex crossover and a difference in the angles $\alpha$ and $\beta$.

Most workers in the art have generally believed that there is little interplay between the beam forming region 7 and the focusing region 8 of the gun; and when attention has been given to one of these two regions for improving the electron gun, usually little note has been given to the other. Notwithstanding this belief in the prior art, we have found that the first crossover, which is imaged on the screen by the focusing system of the gun, is much further forward in the gun than where it was heretofore believed to be. This has in turn led us to realize the interdependence between this beam-forming function of the gun and the subsequent focusing function of the gun. As a result, we have discovered that a judicious choice and combination of design parameters of the gun can produce an unexpected improvement in beam-spot performance of the gun.

SUMMARY OF THE INVENTION

The principal characteristics of the novel electron gun relative to the same class of prior art guns are a thick G2 electrode, a strong electric field between the G2 and G3, and/or an increased object distance of the main focusing system. To obtain optimum results from these design concepts, it is preferable that prefocusing of the electron beam subsequent to the crossover be eliminated or at least significantly reduced.

FIGS. *9a–9d* are schematic illustrations comparing the beam-forming and focusing action of the novel electron gun with that of the prior art guns.

Figure 10:
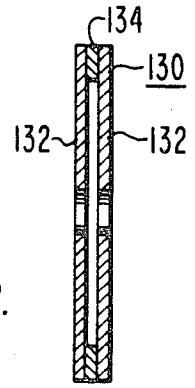
Figure 11:
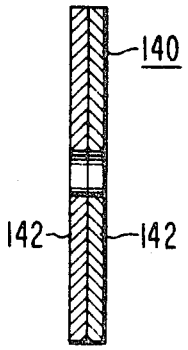

FIGS. 10 and 11 are section views of alternative embodiments of thick G2 electrodes usable in the novel electron gun.

Figure 2:
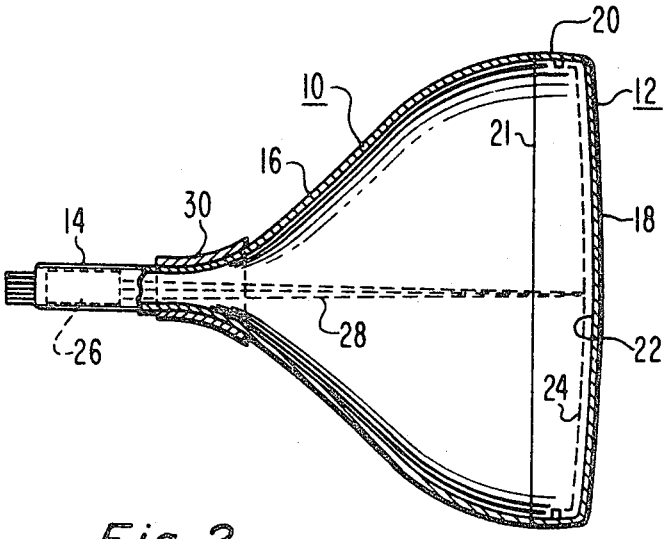
FIG. 2 is a schematic elevation view of a cathode ray tube embodying the novel electron gun.
Figure 12:
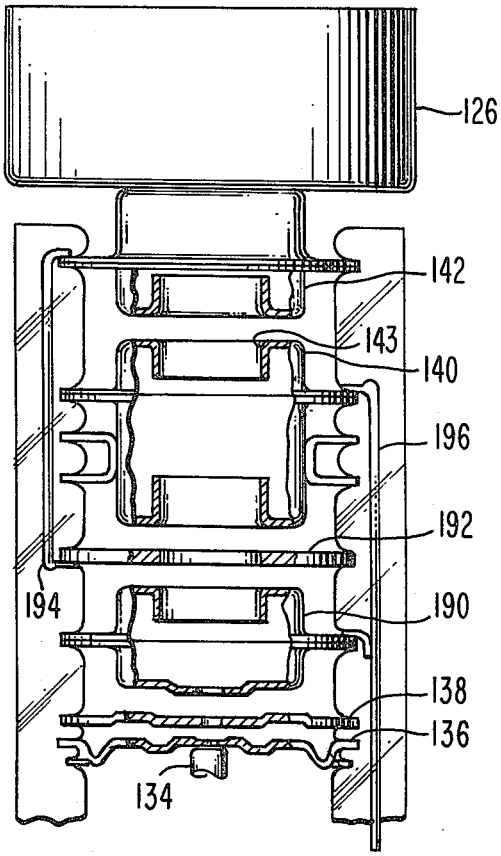

FIG. 12 is a longitudinal section partly in section of another embodiment of the novel electron of FIG. 2.

DETAILED DESCRIPTION OF THE PREFERRED EMBODIMENT

FIG. 2 illustrates a rectangular color picture tube 10 having a glass envelope comprising a rectangular faceplate panel 12 and a tubular neck 14 connected by a rectangular funnel 16. The panel 12 comprises a viewing faceplate 18 and a peripheral side wall 20 which is joined to the funnel 16 with a frit seal 21. A mosaic three-color phosphor screen 22 is disposed on the inner surface of the faceplate 18. The screen is preferably a line screen with the phosphor lines extending perpendicular to the intended direction of high frequency scanning. A multiapertured color section shadow mask electrode 24 is removably mounted by conventional means in predetermined spaced relation to the screen 22. A novel in-line electron gun 26, shown schematically by dotted lines, is centrally mounted within the neck 14 to generate and direct three electron beams 28 along coplanar convergent paths through the mask 24 to the screen 22.

The tube of FIG. 2 is designed to be used with an external magnetic deflection yoke 30 disposed around the neck 14 and funnel 12 in the neighborhood of their junction, for scanning the three electron beams 28 horizontally and vertically in a rectangular raster over the screen 22.

Except for the novel modifications as hereinafter described, the electron gun 26 may be of the 3-beam in-line type similar to that described in U.S. Pat. No. 3,772,554, issued to R. H. Hughes on Nov. 13, 1973. This Hughes patent is incorporated by reference herein for the purpose of disclosure.

Figure 3:
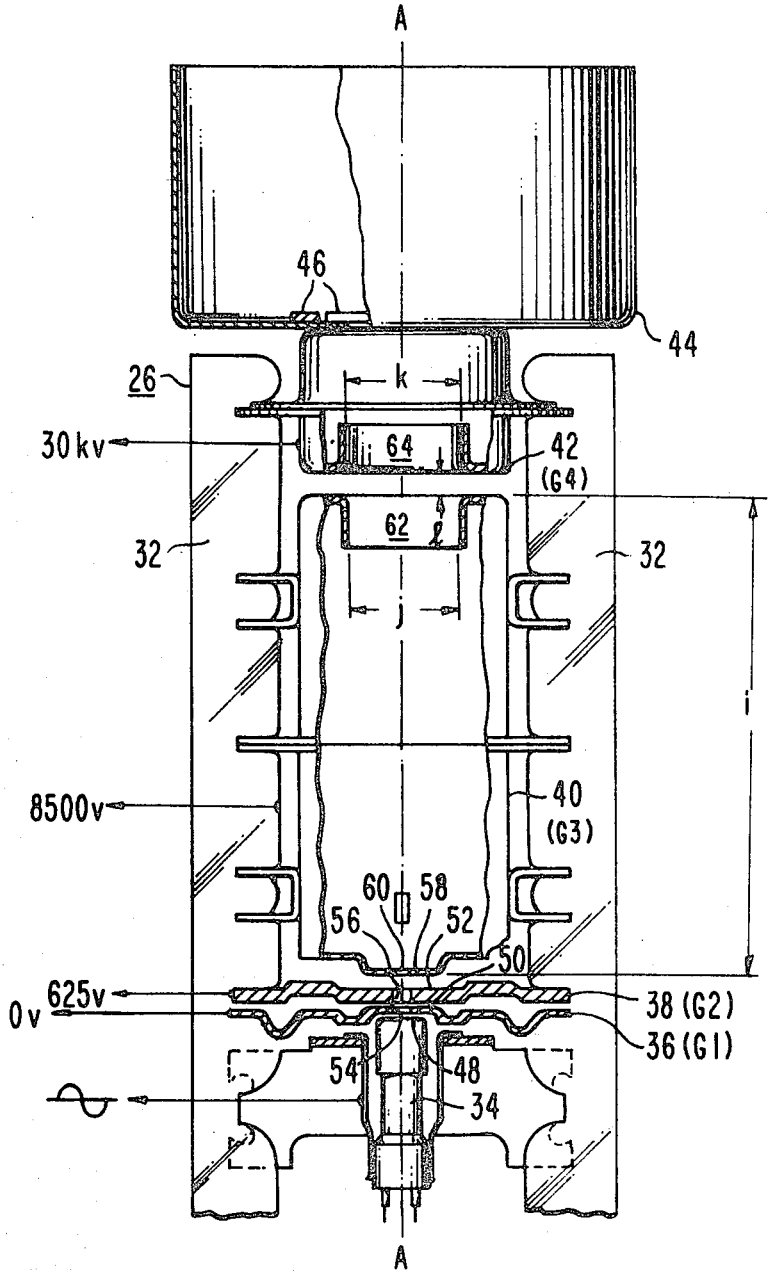
FIG. 3 is a longitudinal elevation, partially in section, of one embodiment of the novel electron gun of FIG. 2.

FIG. 3 is an elevation in partial central longitudinal section of the 3-beam bipotential gun 26, in a plane perpendicular to the plane of the coplanar beams of the gun. As such, structure pertaining to but a single one of the three beams is illustrated in the drawing. The electron gun 26 comprises two glass support rods 32 on which the various electrodes are mounted. These electrodes include three equally spaced coplanar cathodes 34 (one for each beam, only one of which is shown), a control grid (G1) electrode 36, a screen grid (G2) electrode 38, a first lens of focusing (G3) electrode 40, and a second lens or focusing (G4) electrode 42. The G4 electrode includes an electrical shield cup 44. All of these electrodes are aligned on a central beam axis A—A and mounted in spaced relation along the glass rods 32 in the order named. The focusing electrodes G3 and G4 also serve as accelerating electrodes in the bipotential electron gun 26.

Also shown in the electron gun 26 are a plurality of magnetic members 46 mounted on the floor of the shield cup 44 for the purpose of coma correction of the raster produced by the electron beams as they are scanned over the screen 22. The coma correction magnetic members 46 may, for example, be as those described in the above-referenced Hughes patent.

The tubular cathode 34 of the electron gun 26 includes a planar emitting surface 48 on an end wall thereof. The G1 and G2 electrodes include transverse plate portions 50 and 52, respectively, which have aligned central apertures 54 and 56, respectively, therein. The G3 comprises an elongated tubular member having a transverse wall 58 adjacent to the G2, which has a central aperture 60 therein. The G4, like the G3, comprises a tubular member; and these two electrodes, at their facing ends, have inturned tubular lips 62 and 64 between which the main focusing lens of the electron gun is established.

In a bipotential form as described above, the novel electron gun 26 may be characterized by the following:

1. A strong operating electric field between the G2 and G3 of 100–400 volts/mil (3937–15748 volts/mm), and preferably of 150–250 volts/mil (5906–9843 volts/mm) to extract a beam of minimum diameter from the crossover.

2. A thick, flat G2 plate portion 52 whose thickness is from 0.4–1.0 times the diameter of the G2 aperture 56 to reduce the crossover angles of the electron beam.

3. An unusually long G3 having a length of 2.505.0 times the G3 main focus lens diameter to maximize object distance and reduce magnification in the electron gun. In most cases this will be about 40–60 times the thickness of the G2.

4. A G2 which has surrounding its aperture a flat portion whose diameter is equal to or greater than about twice the G2–G3 spacing, to avoid prefocusing of the electron beam.

Figure 4:
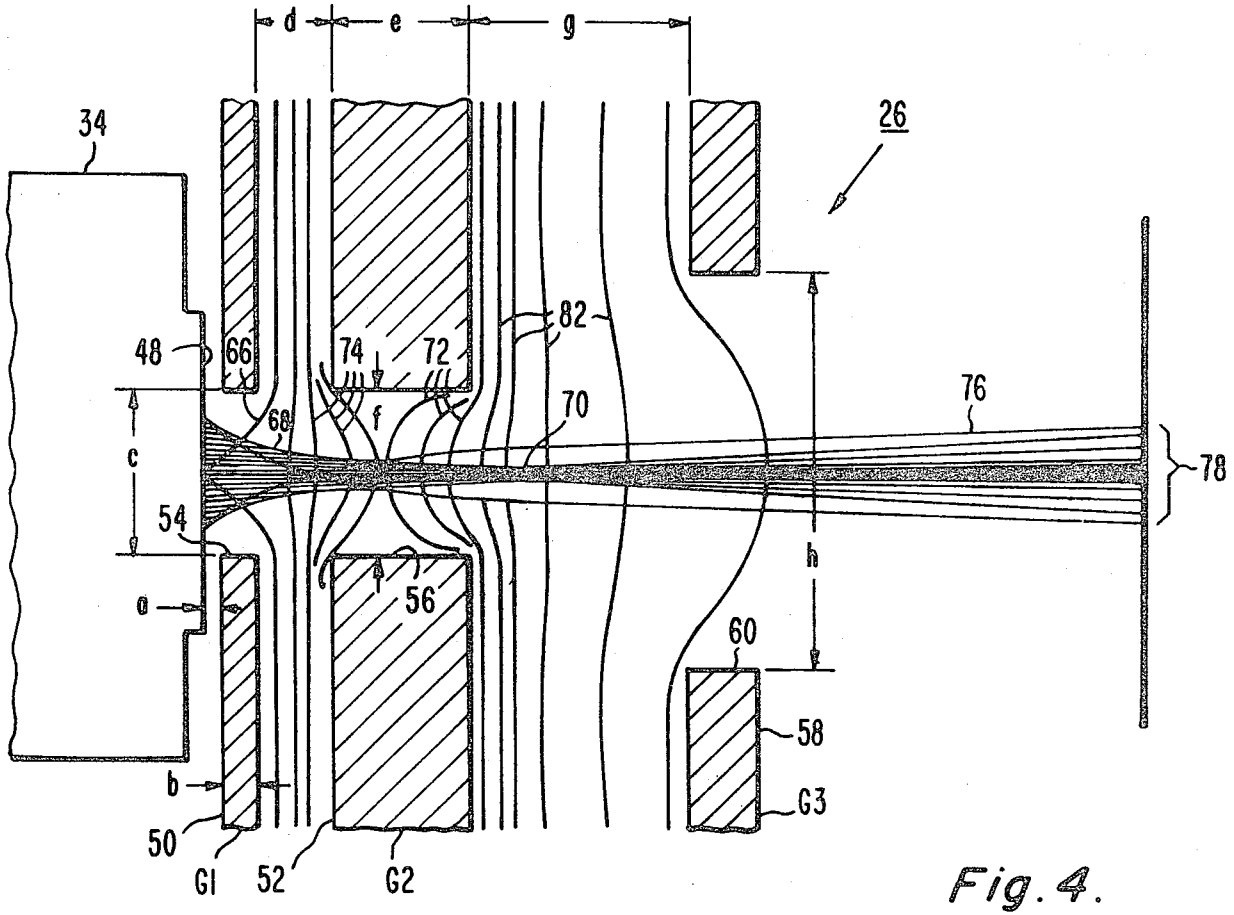
FIG. 4 is an enlarged section of the beam-forming region of the novel electron gun of FIG. 3.

FIG. 4 is a greatly enlarged section of the beamforming region of the novel electron gun 26. This figure illustrates the nature of the equipotential field lines which are developed between the cathode, G1, G2 and G3 during operation of the gun; and also the nature of the electron paths as they leave the cathode, converge to a crossover, and diverge therefrom on their way toward the main focus lens.

Typical of electron guns which operate with a crossover of the beam is the strongly convergent field in the vicinity of the cathode and the G1 represented by the field lines 66. These serve to strongly converge the electron rays 68 as they leave the cathode 34 and form them into a crossover 70 from which they then diverge as they proceed toward the main focus lens.

Figure 1:
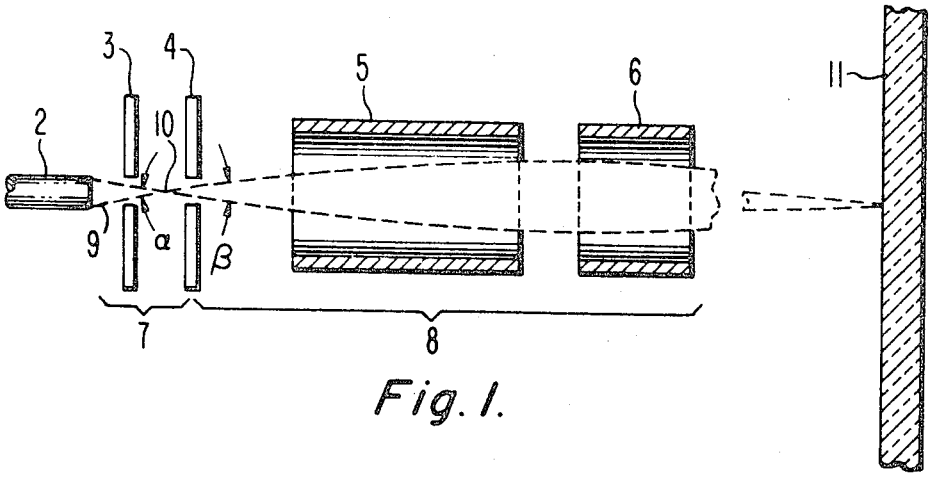
FIG. 1 is a schematic illustration of a typical electron gun and the general nature of the electron beam-forming and focusing functions thereof.

The gun 26 is constructed with a relatively close G2–G3 spacing and/or operated with a relatively high G3 voltage so as to produce a strong field between the G2 and G3. Such high voltage field from the G3 dips into the aperture of the G2 as illustrated by the equipotential lines 72. However, unlike prior art electron guns in which the G2 electrode may be of substantially the same thickness as that of the G1, and wherein the high voltage from the G3 penetrates completely through the aperture of the G2, the thick G2 of the present gun is so thick relative to the diameter of the G2 aperture 56, that the field 72 penetrates only part way through the aperture. This in turn allows the field formed by the G1 voltage, as represented by the field lines 74, to dip into the G2 aperture 56 from the G1 side of the G2 and exert a divergent force on the electron rays 68. This serves to reduce the crossover entrance angle $\alpha$ (see FIG. 1) from that which it would otherwise be and to move the crossover 70 farther forward toward the screen than it would otherwise be. This in turn produces a smaller crossover exit angle $\beta$ and hence a tighter beam bundle as the electron rays 76 diverge from the crossover and proceed toward the main focus lens. At an arbitrarily predetermined distance from the cathode 34, the electron rays 76 are shown to have a relatively small, or tight, bundle 78.

Also characteristic of the novel electron gun 26 is the relatively flat transverse plate portion 52 of the G2. Such a flat electrode structure results in field lines 82 being established between the G2 and G3 which themselves are relatively flat and void of any significant prefocusing action. The avodiance of a prefocusing action in this region of the electron gun results in a reduced magnification as is hereinafter explained in greater detail.

Figure 5:
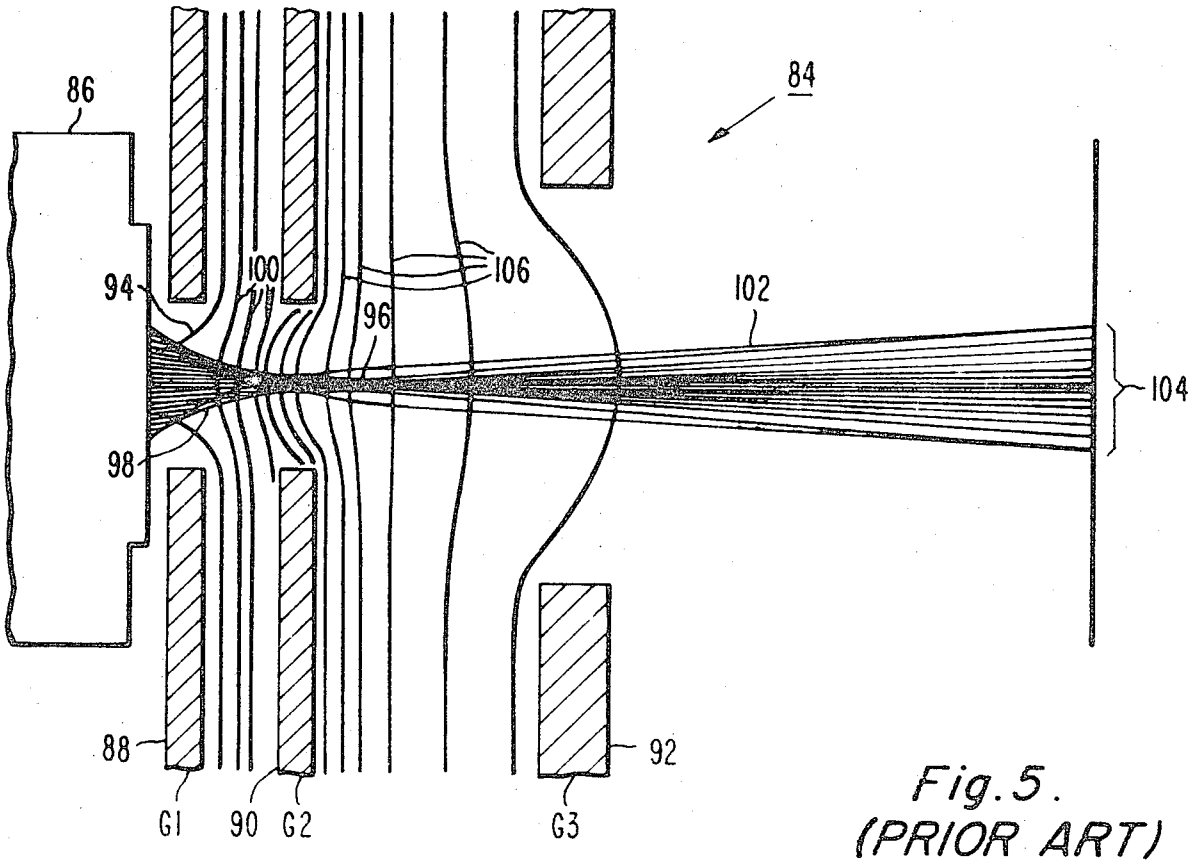
Fig. 5. (PRIOR ART)
FIG. 5 is an enlarged section similar to that of FIG. 4, but illustrating for comparison a beam-forming region of a typical prior art gun.

FIG. 5 is a greatly enlarged section view, similar to that of FIG. 4, but of a prior art gun 84 having a conventional thin-walled G2 rather than the thick G2 of the novel electron gun 26. In FIG. 5 the electron gun 84 comprises a cathode 86, a G1 88, a G2 90, and a G3 92. The prior art electron gun 84 has the identical electrode spacings and dimensions of the electron gun 26, except that its G2 90 is of a thin plate conventional type as opposed to the thick plate G2 38 of the electron gun 26.

The electron gun 84, like the novel gun 26 of FIG. 4, exhibits the strongly converging field represented by equipotential lines 94 in the G1 aperture adjacent to the cathode. As with the novel gun 26, this field converges the electron rays 98 leaving the cathode to a crossover 96. However, with the electron gun 84, by virtue of the thinner nature of the G2 electrode, the field lines from the high G3 voltage penetrate completely through the aperture of the G2, creating additional convergent action in the region between the G1 and the G2, as illustrated by the field lines 100. This is in contrast to the field 74 produced in the novel gun 26. The result of this added convergence action is to create a larger crossover entrance angle $\alpha$ (see FIG. 1) and to move the crossover 96 closer to the cathode than was the case with the novel electron gun 26. A consequence of this is that the crossover exit angle $\beta$ of the electron rays 102 emerging from the crossover 96 is greater, thus producing at the same predetermined distance from the cathode a less tightly grouped beam bundle 104 than the beam bundle 78 of the electron gun 26. The shape of the equipotential field lines 106 between the G2 and G3 in the electron gun 84 are essentially equivalent to the field lines 82 in the novel electron gun 26. However, the strength of the field may be significantly less than with the novel gun 26.

Figure 6:
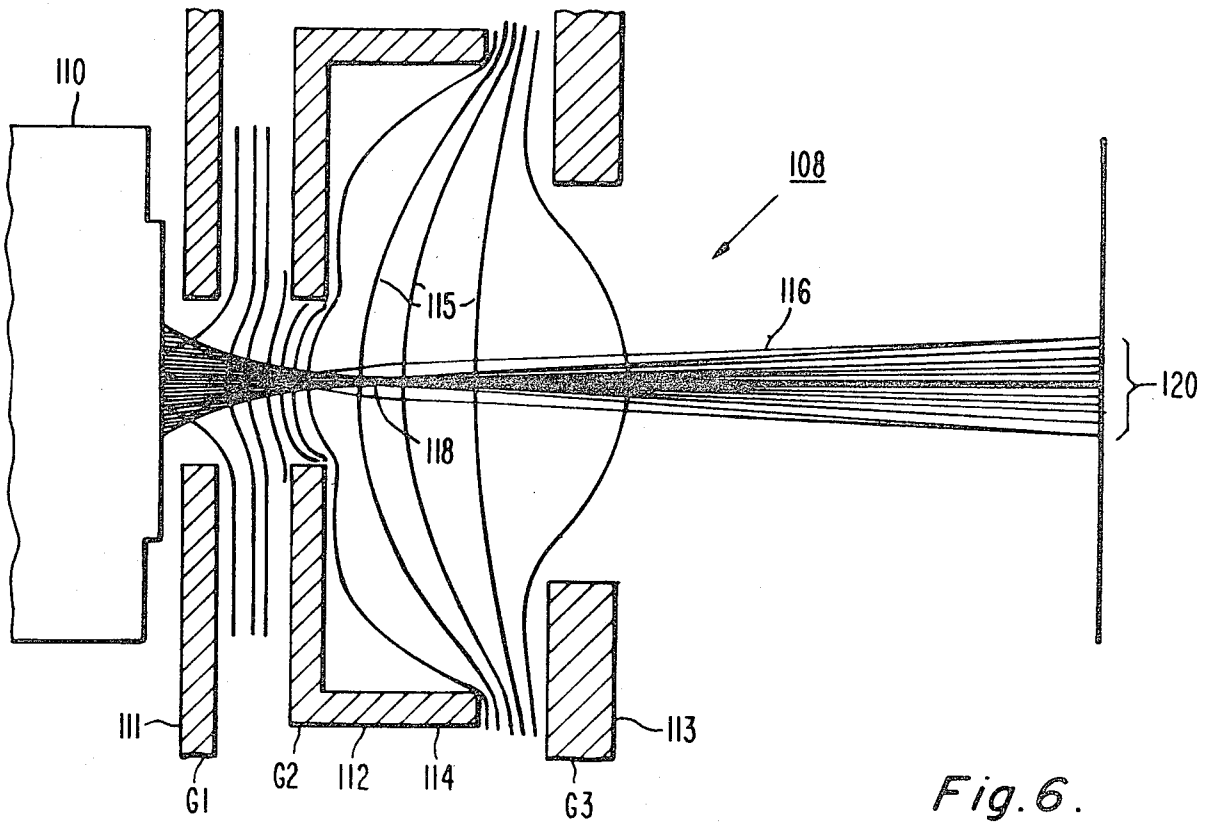
Fig. 6. (PRIOR ART)
FIG. 6 is a view similar to that of FIG. 5, illustrating another prior art type of electron gun.

FIG. 6 illustrates a prior art electron gun 108 which is identical to the prior art gun 84 except for the G2 electrode. The gun 108 includes a cathode 110, a G1

111, a G2 112, and a G3 113. The G2 is of cup-shaped nature including an upstanding peripheral wall 114. The effect of the wall 114 is to shape the equipotential lines 115 in the region between the G2 and G3 to produce a prefocusing convergent action on the electron rays 116 as they depart from the crossover 118 of the beam. The result is to convergently bend the rays 116 after they leave the crossover, to produce a tighter beam bundle 120 somewhat similar in size to that of the beam bundle 78 of the novel electron gun 26. However, as will be explained in greater detail hereinafter, achievement of the tight beam bundle 120 in the electron gun 108 does not allow the achievement also of a reduction of magnification equivalent to that achieved by the novel electron gun 26.

It is the prefocusing action produced by the convergent field lines 115 in the region between the G2 and the G3 that the novel gun 26 is designed to avoid. This is accomplished in the novel gun 26 by the avoidance of any structure, such as the upturned lip 114 of the G2 electrode, which curves the field lines 115 from an otherwise relatively flat character in the vicinity of the electron beam rays 116.

Figure 7:
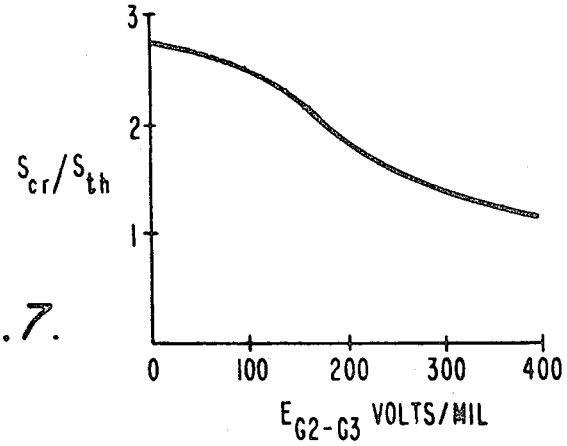
FIG. 7 is a graph illustrating the relationship between beam size at the crossover and electric field strength between G2 and G3.

FIG. 7 illustrates the relationship between beam spot size and the strength of the electric field between a G2 and G3 of a gun of the general class discussed herein. In FIG. 7, field strength is plotted against the ratio of the actual beam spot size $S_{cr}$ at the crossover to the theoretical beam spot size $S_{th}$ at the crossover. The theoretical minimum beam spot size $S_{th}$ at the crossover is that determined by thermal emission contribution to the crossover spot size. As illustrated, the spot size ratio drops sharply as the field strength increases from about 150 to 250 volts/mil (5906–9843 volts/mm) $E_{G2-G3}$ and levels off on either end of this range.

In a typical prior art bipotential gun having a simple single main focus lens such as disclosed in the above cited Hughes patent, there might be provided a G2–G3 spacing of about 55 mils (1.397 mm), a G3 voltage of about 6000 volts and a G2 voltage of about 600 volts. Such construction and operational parameters results in the gun operating with an $E_{G2-G3}$ field of about 98 volts/mil (3858 volts/mm). By comparison typical preferred embodiments of the novel electron gun 26 are preferably provided with G2–G3 spacings of from about 33 to 48 mils (0.838–1.219 mm), a G3 voltage of about 8500 volts and a G2 voltage of about 625 volts, thus resulting in $E_{G2-G3}$ fields of from about 239 to 164 volts/mil (9409–6457 volts/mm). As shown in FIG. 7, the plotted spot size ratio (which is a quality measurement of the spot size with unity being optimum) is about 2.5 for the prior art Hughes gun as compared with about 1.6 for the novel electron gun 26 operated with an $E_{G-2-G3}$ field of 239 volts/mil (9409 volts/mm).

The spot size ratio improvement from 2.5 to 1.6 would suggest that higher $E_{G2-G3}$ fields are desirable. However, in the absence of some compensating changes in the electron gun, the mere increase of the $E_{G2-G3}$ field results in an accompanying increase in the crossover exit angle $\beta$ of the electron beam due to a greatly increased convergent field being established in the G2 aperture prior to the crossover and a greatly increased divergent field being established in the G3 aperture subsequent to the crossover. One standard prior art technique for compensating for the increased crossover exit angle has been the establishing of a prefocusing lens between the G2 and G3. However, as hereinafter explained in detail, such a prefocusing field cannot possibly provide an optimum compensation for the increased crossover exit angle.

Another prior art approach for dealing with such an increase in the crossover exit angle has been that suggested in U.S. Pat. No. 3,995,194 issued to Blacker et al on Nov. 30, 1976 where, in contrast to a simple single lens focusing system, a complex three-lens main focusing system is employed. Such a complex focusing system is, however, costly both from the standpoint of gun construction and provision of the additional operating potentials.

Figure 8:
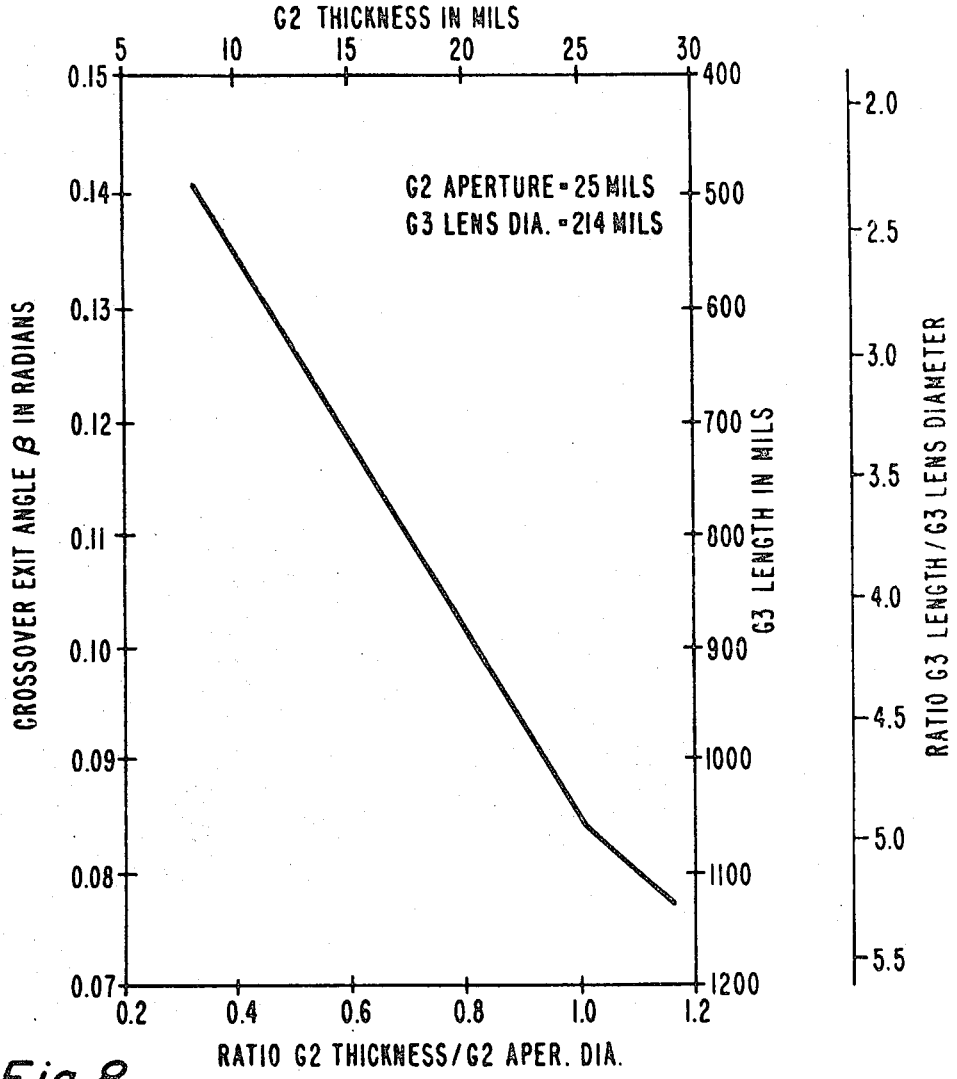
FIG. 8 is a graph showing the relationship between G2 thickness and G3 length in the novel electron gun.

FIG. 8 is a graph showing crossover exit angles $\beta$ and optimized G3 lengths as functions of various G2 thicknesses in an embodiment of the novel electron gun 26 having a G2 aperture diameter of 25 mils (0.635 mm) and a G3 lens diameter of 214 mils (5.436 mm). The curve shows that as G2 thickness is varied from 10 mils (0.254 mm) or 0.4 times the G2 aperture, to 25 mils (0.635 mm), or 1.00 times the G2 aperture, the crossover exit angle $\beta$ decreases from about 0.135 radian to about 0.084 radian. As the crossover angle $\beta$ decreases, the beam diameter is reduced and increasingly longer G3 electrodes can be utilized without over-filling the lens with the beam, thus obtaining an increase in the object distance of the focusing system and a corresponding decrease in magnification. The curve also shows that for a G2 thickness of 10 mils (0.254 mm), an optimized G3 length of 550 mils (13.970 mm) is required, and that for a G2 thickness of 25 mils (0.635 mm) an optimized G3 length of 1060 mils (26.924 mm) is required. The G2 thickness can thus be stated in terms of the ratio of G3 length/G3 lens diameter. This ratio is seen to vary from 2.57 to 4.95 as the G2 thickness varies from 10 to 25 mils (0.254–0.635 mm). A range of suitable G3 lengths thus varies rom about 2.5 to 5.0 for the suitable variation of G2 thickness of 0.4 to 1.0 times the G2 aperture diameter. From these figures it can also be noted that for this particular embodiment of the novel gun 26, the optimized G3 lengths vary from about 40 to 60 times the G2 thickness over the preferred operating range of dimensional variations as described herein.

FIGS. 9*a* through 9*d* schematically illustrate the effects of prior art electron gun design relative to that of the present novel electron gun, with respect to the achievement of a reduced magnification. As is well known in the art, the magnification of an electron gun is expressed by the formula $$M = \frac{Q}{P}\sqrt{\frac{V_c}{V_a}} \tag{1}$$

wherein:

M is the magnification of the beam spot;

Q is the image distance, i.e., the distance between the main focus lens and the image plane on which the beam spot is to be imaged;

P is the object distance, i.e., the distance between the beam crossover and the main focus lens;

$V_c$ is the voltage at the crossover, and $V_a$ is the voltage at the anode or image plane.

Figure 9A:
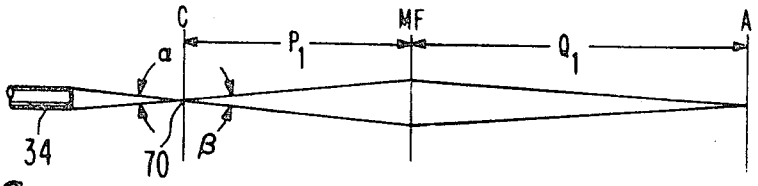

FIG. 9*a* illustrates the nature of the electron beam formation in the novel electron gun 26 wherein electrons are converged from the cathode 34 to a first crossover 70 at a relatively long distance from the cathode and with a relatively small crossover entrance angle $\alpha$. The electrons then diverge from the crossover to a main focus lens MF where they are focused to image the crossover on the anode A. By virtue of a relatively small crossover exit angle $\beta$, the expansion of the beam bundle when it reaches the main focus lens is still relatively small, thus allowing it to operate in the low spherical aberration central region of the lens and produce a relatively unaberrated beam spot on the screen. Also, because of this relatively small crossover exit angle $\beta$ of the beam, the object distance $P_1$ is relatively large. Accordingly, relative to prior art guns, a favorable, or reduced, magnification is achieved by virtue of the reduced ratio of $Q_1/P_1$.

Figure 9B:
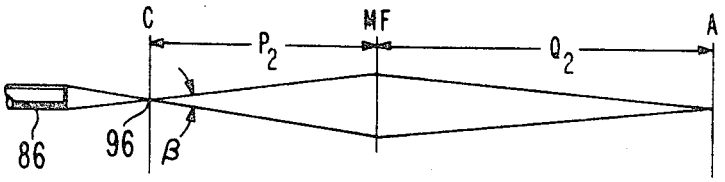

FIG. 9*b* illustrates the effect of attempting to achieve the same magnification with the prior art electron gun 84 by making $P_2$ equal to $P_1$. Since the gun 84 operates with a larger crossover exit angle $\beta$, its electron rays diverge rapidly from the crossover 96, and by the time they reach the main focus lens MF they have expanded to such a large size that they suffer severe spherical aberrations in passing through the lens aperture.

Figure 9C:
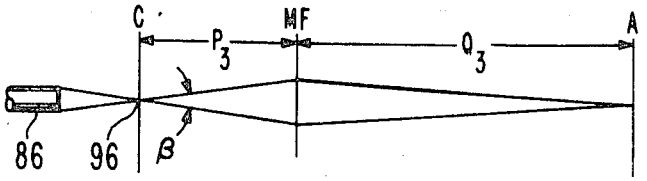

FIG. 9*c* illustrates, for the electron gun 84, one attempted solution to the problem described with respect to FIG. 9*b*. Here the cathode 86 of the gun is moved closer to the main focus lens MF such that the object distance $P_3$ is reduced, so that the expansion of the beam bundle will not be excessive by the time it reaches the main focus lens. This, of course, avoids severe spherical aberrations, but results in increased magnification due to a reduced object distance $P_3$ and consequently an increased $Q_3/P_3$ ratio.

Figure 9D:
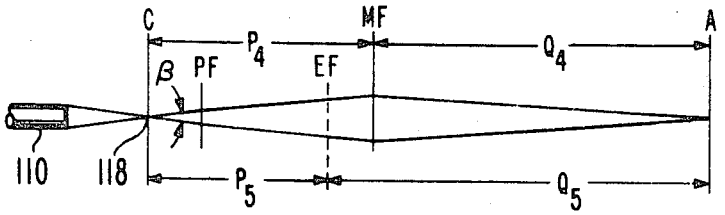

FIG. 9*d* illustrates the attempts of the prior art to solve the problems described with respect to FIGS. 9*b* and 9*c* by the use of a prefocus lens in the electron gun 108. Because the electrons leave the crossover 118 with a relatively large crossover exit angle $\beta$, they are prefocused in the region between the G2 and the G3 with the prefocusing lens PF as described with reference to FIG. 6. The electrons then leave the prefocusing lens PF with a smaller divergence such that, when they reach the main focus lens MF, they are in a relatively tight beam bundle similar in size to that achieved with the novel electron gun 26 (FIG. 9*a*). This would appear to achieve an equivalent magnification since $Q_4/P_4$ is equal to $Q_1/P_1$. However, this achievement is fictitious since in the electron gun 108 of FIG. 9*d*, focusing is achieved by a pair of lenses, viz., the prefocusing lens PF and the main focus lens MF. These two lenses produce an equivalent focusing lens MF located between the prefocusing and main focusing lens, thus producing an effective object distance $P_5$ and an effective image distance $Q_5$. The result is a magnification proportional to $Q_5/P_5$ which is greater than that achieved by the novel electron gun 26 having a magnification proportional to $Q_1/P_1$ as illustrated in FIG. 9*a*.

The comparisons discussed with reference to FIGS. 9*a*–9*b* illustrate the advantage to be achieved in obtaining a tight beam bundle, not as a focusing function provided by a prefocusing lens following the G2, but as a beam-forming function provided in the region of the G1 and G2. This advantage is achieved through the use of a high $E_{G2-G3}$ field and a thick G2 relative to the G2 aperture.

In a preferred bipotential embodiment of the invention as incorporated in the novel electron gun 26, the following dimensions, spacings and operating potentials are used:

| | mils | mm |
|---|---|---|
| Cathode - G1 spacing "a" | 3 | 0.076 |
| G1 thickness "b" | 5 | 0.127 |
| G1 aperture diameter "c" | 25 | 0.635 |
| G1 - G2 spacing "d" | 11 | 0.279 |
| G2 thickness "e" | 20 | 0.508 |
| G2 aperture diameter "f" | 25 | 0.635 |
| G2 - G3 spacing "g" | 33 | 0.838 |
| G3 aperture diameter "h" | 60 | 1.524 |
| G3 length "i" | 925 | 23.495 |
| G3 lens diameter "j" | 214 | 5.436 |
| G4 lens diameter "k" | 227 | 5.766 |
| G3 - G4 spacing "l" | 50 | 1.270 |
| | | volts |
| Cathode cutoff potential | | 150 |
| G1 potenial | | 0 |
| G2 potential | | 625 |
| G3 potential | | 8500 |
| G4 potential | | 30000 |

The thick G2 of the novel gun 26 has heretofore been described as comprising a single thick apertured plate 52. However, the apertured plate of the thick G2 may be provided by a stack or lamination of a plurality of thinner apertured plates having their apertures aligned.

For example, FIG. 10 shows an alternative thick G2 130 comprising a pair of relatively thin apertured plates 132 separated by a spacer 134. The effective thickness of the G2 130 is the distance between the outwardly facing surface of one of the apertured plates 132 to the oppositely outwardly facing surface of the other plate 132.

FIG. 11 illustrates another alternative embodiment of a thick apertured G2 140. The G2 140 comprises a pair of medium thick apertured plates 142 which are abutted flush with one another and which have the apertures aligned. The effective thickness of the thick G2 140 is the distance from the outwardly facing surface of one of the plates 42 to the oppositely outwardly facing surface of the other plate 142.

General Considerations

Generally speaking, for a given G3 voltage, the smaller the G2–G3 spacing, the more desirable the electron optical characteristics of the electron gun. As the G2–G3 field is increased toward 400 volts/mil (15748 volts/mm), an increasingly smaller spot size is produced on the screen, all other factors being fixed. For example, a novel gun 26 made with a 33 mil (0.838 mm) G2–G3 spacing, operated at 239 volts/mil (9409 volts/mm) $E_{G2-G3}$, provided a spot size at a given beam current of 2.75 mm, whereas the same gun with a 48 mil (1.219 mm) G2–G3 spacing and at the same $E_{G2-G3}$ and beam current provided a spot size of 2.95 mm. If the G2–G3 spacing is made so small as to obtain an $E_{G2-G3}$ greater than 400 volts/mil (15748 volts/mm), a problem of severe voltage instability results, with arc-overs occurring between the G2 and G3 electrodes. An $E_{G2-G3}$ of 150–250 volts/mil (5906–9843 volts/mm) has proved to be a preferred working range. This range covers the steepset portion of the curve where the most significant adjustment of the beam character is obtained for a given change of field strength. The lower end of this preferred range provides a significant improvement over prior art guns which operate at about 100 volts/mil $E_{G2-G3}$, while the upper end of the preferred range stays well clear of any severe voltage breakdown problem.

The diameters of the G1 and G2 apertures are chosen following conventional electron gun design criteria. Consideration is given to maximum beam current desired, spot size, and drive sensitivity. The thickness of the G2 is then determined in accordance with design criteria of the present teaching. A G2 thickness of 0.4–1.0 times the diameter of the G2 aperture has proved to provide the desired divergent action at the entrance to the G2. If the G2 thickness is made less than 0.4 times the diameter of the G2 aperture, too little or no divergent action is obtained. As the G2 thickness begins to exceed the size of the G2 aperture, aberration effects become pronounced and the outer electron rays of the beam begin to be directed inwardly to a premature crossover resulting in a defocused beam spot which appears as a dense core having a halo therearound. Furthermore, as the ratio of G2 thickness to G2 aperture diameter begins to exceed unity, a useless drift region is created through the G2, and the aperture becomes increasingly difficult to fabricate from a grid blank by conventional punching techniques. Thus, the range of 0.4 to 1.0 constitutes a practical range, not only from the standpoint of electron optics, but also from the standpoint of mechanical fabrication procedures.

The length of the G3 is selected so that the electron beam has a diameter in the main focus lens at the far end of the G3 of approximately half or slightly less than half the diameter of the lens-forming opening in the G3 when the gun is operated at an arbitrarily chosen standard highlight drive current of 3.5 milliamps. In a gun having the preferred structural dimensions and operating voltages set forth above, the electron beam diameter in the main focus lens was about 87.74 mils (2.229 mm), or 0.41 times the diameter of the G3 at the lens when driven at 3.5 milliamps beam current. If the G3 is made longer, the object distance is increased and the magnification thereby further reduced. However, in so doing the beam diameter becomes larger in the lens, and spherical aberration of the lens becomes a greater problem. If the G3 is made shorter, spherical aberration is reduced, but at the sacrifice of an increase in magnification. Designing the gun to provide the maximum acceptable beam diameter in the main focus lens also obtains the advantage of a less dense beam which suffers less from space charge effects. As the G2 thickness is varied from about 0.4 to 1.0 times the G2 aperture diameter, the crossover exit angle $\beta$ of the beam varies from about 0.135–0.084 radian, so that the G3 length is optimized from about 2.5–5.0 times the diameter of the G3 lens opening.

Experiments have shown that the 2.5–5.0 relationship between G3 length and G3 lens diameter holds not only for 25-mil (0.635-mm) G2 apertures (FIG. 7), but for other suitable aperture sizes as well.

In addition to spherical aberration being a limiting factor in allowable beam diameter, so also are distortions which the yoke field produces on the beam cross section if the beam diameter is allowed to become excessively large in the yoke field. This is especially true of the recently developed self-converging, precision-inline type of tube-yoke combinations.

A reduced crossover angle, as taught herein, requires a weaker main focusing lens to image the crossover on the screen. Since the main focus lens is established between the G3 and G4, and since the G4 has the ultor screen potential applied thereto, the G3 voltage must be higher than that of a conventional gun in order to provide the desired weak lens. This has the effect of providing greater penetration of the G3 voltage into the G2 aperture, which theoretically conflicts with the desire to avoid complete penetration to allow creation of the desired divergent field action at the entrance of the G2 aperture. However, this apparent conflict can be compensated for by simply increasing the ratio of G2 thickness/G2 aperture diameter beyond that which would otherwise be required. An advantage of the weak main lens is inherently lower spherical aberration.

Experiments have shown that a G1–G2 spacing of from 9–15 mils (0.229–0.381 mm) provides an optimum workable range. If the spacing is made greater than 15 mils (0.381 mm), the divergent field at the entrance of the G2 moves into or beyond the crossover, thus failing to obtain the desired effect of a reduction in the crossover entrance angle $\alpha$. If this spacing is made less than about 9 mils, mechanical tolerance problems resulting in G1–G2 shorts begin to prevail. Furthermore, if the spacing is made significantly less than 9 mils, the resultant divergent field at the entrance of the G2 can be strengthened such that the electron beam is so compressed that space charge effects take over and destroy the benefits of the desired small crossover angle. A similar result of too strong a diverging field at the entrance to the G2 occurs if the voltage difference between the G1 and the G2 is made too great.

Variations in the strength of the divergent field at the entrance to the G2 aperture, in addition to affecting the size of the crossover entrance angle $\alpha$, also have the effect of moving the crossover forward or rearward. However, this movement of the crossover is by a relatively small amount and thus does not become a significant design criterion.

Although the curve of FIG. 8 calls for a G3 length of slightly less than 900 mils (22.86 mm) for a 25-mil (0.889-mm) G2 aperture, in the specific dimensional data set forth as an example of the novel electron gun 26, a G3 length of 925 mils (23.495 mm) was provided. This additional length was added to the G3 for the purpose of achieving an overall structure which would operate properly with a G3 voltage of 8500 volts and with 30,000 volts on the G4. The departure from optimum G3 length is insignificant considering the trade off of spherical aberration versus magnification.

The novel electron gun structure has been described as comprising a part of a 3-beam inline gun. However, the novel structure may also be embodied in a 3-beam delta gun or in a single-beam gun. Similarly, although described as embodied in a bipotential type gun, the novel structures may be embodied in other types of guns such as those using double bipotential, tripotential, or unipotential focusing systems.

For other than simple bipotential focusing systems, the data given herein for G3 length may not be applicable. However, appropriate lengths of the focusing electrodes employed may be determined simply by determining the location of the focus lens or lenses such that optimum filling of the lens or lenses by the electron beam is established.

Detailed Description of Another Embodiment

An example of an electron gun 126 other than a simple bipotential type is illustrated in FIG. 12. The electron gun 126 includes some parts which correspond functionally to parts of the electron gun 26 of FIG. 3 and are therefore referenced with numerals 100 larger than the corresponding numerals used in FIG. 3. To this end the electron gun 126 includes a cathode 134, a control grid 136, a screen grid 138 and first and second lens electrodes 140 and 142 respectively. The first lens electrode 140 is of shorter axial length than the first lens electrode 40 of the electron gun 26 for reasons which will be hereinafter discussed. The first lens electrode 142 has a lens aperture 143 at its far end.

Unlike the electron gun 26, the electron gun 126 also includes two intermediate electrodes 190 and 192 disposed in the order named between the screen grid 138 and the first lens electrode 140. A first interconnector 194 electrically interconnects the second intermediate electrode 192 to the second lens electrode 142. A second interconnector 196 electrically interconnects the first intermediate electrode 190 to the first lens electrode 140. The second interconnector 196 also extends beyond the gun 126 to serve as an electrical feed terminal.

In one example, the electron gun 126 has the following dimensions and spacings:

| | mils | MM |
|---|---|---|
| aperture diameter of electrode 136 | 22 | 0.559 |
| aperture diameter of electrode 138 | 25 | 0.635 |
| first aperture diameter of electrode 190 | 60 | 1.524 |
| aperture diameter of electrode 192 | 214 | 5.436 |
| tubular aperture diameters of electrodes 190 and 140 | 214 | 5.436 |
| tubular aperture diameter of electrode 142 | 230 | 5.842 |
| thickness of electrode 136 | 5 | 0.127 |
| thickness of electrode 138 | 15 | 0.381 |
| thickness of electrode 192 | 15 | 0.381 |
| length of electrode 190 | 240 | 6.096 |
| length of electrode 140 | 395 | 10.033 |
| length of electrode 142 | 280 | 7.112 |
| spacing between electrodes 134 & 136 | 3 | 0.076 |
| hot spacing between electrodes 136 & 138 | 11 | 0.279 |
| spacing between electrodes 138 & 190 | 55 | 1.397 |
| spacing between electrodes 190 & 192 | 50 | 1.270 |
| spacing between electrodes 192 & 140 | 50 | 1.270 |
| spacing between electrodes 140 & 142 | 50 | 1.270 |

The operating potentials which are applied to the gun 126 having the above dimensions are as follows:

| | VOLTS |
|---|---|
| cathode cutoff potential | 150 |
| electrode 136 | 0 |
| electrode 138 | 620 |
| electrodes 190 and 140 | 7,000 |
| electrodes 192 and 142 | 25,000 |

In operation of the electron gun 126, a high voltage viz, the ultor screen voltage, is applied to the second lens electrode 142 and hence to the second intermediate electrode 192. A lower focus voltage is applied via the connector 196 to the first intermediate electrode 190 and to the first lens electrode 140. As a result, a main bipotential focus lens is established between the first and second lens electrodes 140 and 142, and a secondary unipotential prefocus lens is established between the first intermediate electrode 190 and the first lens electrode 140 centered at the second intermediate electrode 190. However, since the voltage applied to successive electrodes 190, 192, 140, and 142 are respectively low, high, low, high, this type of gun is ofter referred to as a double bipotential type.

Consistant with the teachings set forth with reference to the bipotential gun 26 concerning reduction of magnification by optimizing the object distance, the cumulative lengths of the electrodes 190, 192, 140 and the spacings therebetween in the electron gun 126 are selected to provide a main lens filling by the electron beam of about 50% or slightly less. This objective is met by making the cumulative length of the electrodes 190, 192, 140 and the spacings therebetween within the range of 2.5–5.0 times the diameter of the lens aperture 143.

Since the limits of the 2.5–5.0 range described and claimed herein are determined not be any precise factors, but rather by approximate qualitative criteria, this range can be used to define with equal accuracy the relationships of the lens aperture diameter with several alternative expressions of electrode length and/or spacings as follows:

1. The object distance of the simple bipotential gun 26, i.e. the distance from the crossover to the midplane of the main focus lens between the G3 and G4.
2. The length of G3 in the gun 26.
3. The cumulative length of electrodes 190, 192, and 140 plus the spacings therebetween of the gun 126 (which is analogous to the length of the G3 in gun 26).
4. The distance from the screen grid to the far end of the first lens electrode 40 of gun 26 or 140 of gun 126.
5. The distance which the main focus lens is spaced from the screen grid in either the gun 26 or 126.

We claim:

1. An electron gun comprising in spaced relation, in the order named, a cathode, an apertured plate control grid (G1), an apertured plate screen grid (G2), a tubular first lens electrode (G3), and a second lens electrode (G4), wherein:

(a) said G2 has a thickness of 0.4–1.0 times the diameter of the G2 aperture, and (b) said G3 has a length of 2.5–5.0 times the G3 lens diameter.

2. The electron gun of claim 1 wherein said G2 is structured to establish between said G2 and G3 a substantially flat electrostatic field which is substantially void of prefocusing action.

3. The electron gun of claim 1 having approximately the following dimensions and spacings:

| | mils | mm |
|---|---|---|
| Cathode - G1 spacing | 3 | 0.076 |
| G1 thickness | 5 | 0.127 |
| G1 aperture diameter | 25 | 0.635 |
| G1 - G2 spacing | 11 | 0.279 |
| G2 thickness | 20 | 0.508 |
| G2 aperture diameter | 24 | 0.635 |
| G2 - G3 spacing | 33 | 0.838 |
| G3 aperture diameter | 60 | 1.524 |
| G3 length | 925 | 23.495 |
| G3 lens diameter | 214 | 5.436 |
| G4 lens diameter | 227 | 5.766 |
| G3 - G4 spacing | 50 | 1.270 |

4. The electron gun of claim 3 adapted for operation with the following electrical potentials:

| | volts |
|---|---|
| G1 potential | 0 |
| G2 potential | 625 |
| G3 potential | 8500 |
| G4 potential | 30000 |

5. An electron gun comprising in spaced relation, in the order named, (a) a cathode;

(b) an apertured plate control grid (g1);

(c) an apertured plate screen grid (G2), said plate having a thickness of 0.4–1.0 times the diameter of the aperture therein;

(d) a first lens electrode (G3) having a lens aperture therein, said electrode having a length of 2.5–5.0 times the diameter of said lens aperture;

(e) a second lens electrode (G4); and (f) means for establishing an electric $E_{G2-G3}$ field between the G2 and G3 of 100–400 volts/mil (3937–15748 volts/mm).

6. The electron gun of claim 5 wherein said G2–G3 field is about 150–250 volts/mil (5906–9843 volts/mm).

7. The electron gun of claim 6 wherein said means includes a G2–G3 spacing of about 33–48 mils (0.838–1.219 mm).

8. An electron gun comprising in spaced relation, in the order named, a cathode, an apertured plate control grid, an apertured plate screen grid, a tubular first lens electrode having a lens aperture at its far end, and a tubular second lens electrode, wherein:

(a) said screen grid has a thickness of 0.4–1.0 times the diameter of its aperture, whereby penetration through the screen grid aperture toward the control grid of a high voltage field beyond the screen grid is reduced, thereby allowing formation of divergent field action between the control and screengrids which results in a reduction of beam crossover angle and a consequent reduction in spherical aberration in a main focus lens established between said lens electrodes;

(b) said first lens electrode is disposed with its lens aperture a distance of 2.5–5.0 times its diameter beyond said screen grid, whereby said resulting reduction in spherical aberration is traded off for an increased object distance in the focusing system of said gun, thereby reducing magnification; and (c) said screen grid is structured to establish a flat electrostatic field between the screen grid and the next electrode there beyond which is substantially void of prefocusing action, whereby maximum object distance is obtained.

9. An electron gun for generating a beam of electrons which is converged to a crossover that is imaged by an electron lens at an image plane, said gun comprising in spaced relation, in the order named, a cathode, an apertured plate control grid (G1), an apertured plate screen grid (G2), a first lens electrode (G3), and a second lens electrode (G4), said grids and electrodes being dimensioned and spaced to provide:

(a) means for reducing the penetration through the G2 aperture of a high voltage G2–G3 field $E_{G2-G3}$ and for establishing a divergent shape to a G1–G2 field at the entrance to the G2 aperture, to reduce the beam crossover entrance angle and thus the spherical aberration experienced by said beam in said electron lens;

(b) means for trading off the reduced spherical aberration in said electron lens for an increased object distance in the focusing system of said gun; and (c) means for establishing a substantially flat electrostatic field between the G2 and G3 which is substantially void of prefocusing action, whereby maximum object distance is obtained.

10. The electron gun of claim 9, further comprising:

means for increasing the $E_{G2-G3}$ field so as to extract said beam from said crossover with reduced space charge and aberration effects thereon.

11. An electron gun comprising a cathode, a control grid (G1), an apertured plate screen grid (G2), and a tubular lens electrode (G3), having a lens aperture at its far end all of which are adapted to be operated with appropriate electrical potentials applied thereto to generate and project a beam of electrons from said cathode to a crossover and to focus said beam emerging from said crossover by a focus lens established at the far end of said G3;

the spacing between said G2 and G3 being such as to establish between G2 and G3 and $E_{G2-G3}$ electric field of 100–400 volts/mil (3937–15748 volts/mm), said G2 having a ratio of plate thickness to aperture diameter of 0.4–1.0, and said G3 having a length equal to 2.5–5.0 times the diameter of its lens aperture.

12. The electron gun of claim 11 wherein said $E_{G2-G3}$ field is about 150–250 volts/mil (5906–9843 volts/mm).

13. The electron gun of claim 12 wherein said G2–G3 spacing is from about 33 to 48 mils (0.838–1.219 mm).

14. The electron gun of claim 12 wherein said $E_{G2-G3}$ field is about 239 volts/mil (9409 volts/mm) and said G2 ratio of about 0.8.

15. The electron gun of claim 14 wherein said G2–G3 spacing is about 33 mils (0.838 mm), said G2 plate thickness is about 20 mils (0.508 mm), and said G-2 aperture diameter is about 25 mils (0.636 mm).

16. The electron gun of claim 11 wherein said G3 has a length of about 925 mils and a lens aperture diameter of about 214 mils.

17. An electron gun comprising in spaced relation, in the order named, a cathode, an apertured plate control grid, an apertured plate screen grid, and tubular first and second lens electrodes between which a main focus lens is established during operation of said gun, and wherein:

(a) said screen grid has a thickness of 0.4–1.0 times the diameter of the screen grid aperture, and (b) said main focus lens is spaced from said screen grid a distance of 2.5–5.0 times the lens diameter of said first lens electrode.

18. The electron gun of claim 17, which further includes two intermediate electrodes between said screen grid and said first lens electrode and wherein the one of said intermediate electrodes adjacent to the screen grid is electrically interconnected to said first lens electrode and the one of said intermediate electrons adjacent to said first lens electrode is electrically interconnected to said second lens electrode.

19. The electron gun of claim 17, wherein said first lens electrode is immediately adjacent to said screen grid.

20. An electron gun comprising in spaced relation, in the order named, a cathode, an apertured plate control grid, an apertured plate screen grid and tubular first and second lens electrodes, wherein:

(a) said screen grid has a thickness of 0.4–1.0 times the diameter of the screen grid aperture, and (b) the end of said first lens electrode remote from said screen grid is spaced from said screen grid a distance of 2.5–5.0 times the lens diameter of said first lens electrode.

21. The electron gun of claim 20, which further includes two intermediate electrodes disposed between said screen grid and said first lens electrode, and wherein the cumulative lengths of said intermediate electrodes, said first lens electrode, and the spacings therebetween is such as to space the end of said first lens electrode remote from said screen grid at its prescribed distance from said screen grid.

22. The electron gun of claim 20, wherein said first lens electrodes is immediately adjacent to said screen grid and is of appropriate length to space its end which is remote from said screen grid at the prescribed distance from said screen grid.

* * * * *